US007083448B2

(12) United States Patent
Tanigawa

(10) Patent No.: US 7,083,448 B2
(45) Date of Patent: Aug. 1, 2006

(54) CARD EDGE CONNECTOR WITH EJECTING MECHANISM

(75) Inventor: Junichi Tanigawa, Kanagawa (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 11/072,934

(22) Filed: Mar. 4, 2005

(65) Prior Publication Data

US 2005/0196992 A1 Sep. 8, 2005

(30) Foreign Application Priority Data

Mar. 5, 2004 (JP) ..... 2004-061684

(51) Int. Cl.
*H01R 13/62* (2006.01)

(52) U.S. Cl. ..... 439/160; 439/328

(58) Field of Classification Search ..... 439/152, 439/155, 157, 160, 325, 328, 377
See application file for complete search history.

(56) References Cited

U.S. PATENT DOCUMENTS 5,429,523 A * 7/1995 Tondreault ..... 439/157
5,577,922 A 11/1996 Enomoto et al.
6,368,124 B1 4/2002 Wang

FOREIGN PATENT DOCUMENTS

JP 8203608 8/1996

* cited by examiner

*Primary Examiner*—Tho D. Ta
*Assistant Examiner*—Vanessa Girardi
(74) *Attorney, Agent, or Firm*—Barley Snyder LLC

(57) ABSTRACT

Cards are enabled to be removed from a card edge connector having an ejecting mechanism, even in cases that fingers, jigs, and the like are unable to access an ejector thereof. The card edge connector is constituted by: an insulative housing having a slot; electrical contacts, provided in the slot, for electrically contacting conductive pads of a card, which is inserted into the slot; and the ejector, mounted only at one end of the insulative housing in its longitudinal direction, for ejecting the card. The card edge connector is constructed such that when a second edge of the card, opposite from a first edge at which an engaging protrusion is provided, is pulled in a direction substantially opposite the insertion direction of the card, the card rotates about the first edge, while the engaging protrusion urges a stopper to rotate the ejector, thereby disengaging the stopper from the engaging protrusion.

6 Claims, 8 Drawing Sheets

CARD EDGE CONNECTOR WITH EJECTING MECHANISM

FIELD OF THE INVENTION

The present invention relates to a card edge connector, and, particularly to a card edge connector having an ejecting mechanism, for ejecting a card (circuit board) mounted thereto.

BACKGROUND OF THE INVENTION

A conventional card edge connector having an ejecting mechanism is disclosed in Japanese Unexamined Patent Publication No. 8(1996)-203608 (FIG. 1 and FIG. 5). This card edge connector comprises a L-shaped lever that extends along a lateral edge of a card. The lever is rotatably mounted at a first end of an elongate connector housing. The connector housing is equipped with a slot, which is formed along its longitudinal direction, for receiving the card (circuit board). The L-shaped lever is mounted toward a first end of the slot. The rotational center of the lever is toward the first end of the connector housing. The lever comprises: an operating portion, which is positioned at the lower edge of the inserted card (circuit board); and a handle portion, which is formed integrally with the operating portion and extends in the insertion/extraction direction of the card. To eject a card which is mounted in this card edge connector having an ejecting mechanism, the handle portion of the lever is moved outward within a plane parallel to the main surface of the inserted card. This outward movement causes the operating portion to lift the card in the manner of a lever, to eject the card from the slot.

Another conventional card edge connector having an ejecting mechanism is known, as disclosed in U.S. Pat. No. 5,577,922 (FIG. 5, FIG. 6, and FIG. 7). This card edge connector comprises an ejector that extends from a connector housing along the lateral edge of a card. To eject a card which is mounted in this connector, the upper edge of the ejector is pressed toward the connector housing along the lateral edge of the card. This pressing motion causes a cam portion of the ejector to push the card out from the slot.

Meanwhile, cards (miniature circuit boards), which are utilized by personal computers and the like, are increasing in capacity. Along with this increase, the number of electronic components, such as IC chips, which are mounted on the cards, is increasing. These increases are causing the cards themselves to become large in size. As a large card of this type, there are graphic cards and the like, as disclosed, for example, in U.S. Pat. No. 6,368,124 (FIG. 2). This type of card has a width, which is wider than that of a connecting portion and perpendicular to the insertion/extraction direction thereof. Another characteristic of the shape of the card is that an engaging protrusion, for engaging an ejector, is provided.

Both of the conventional card edge connectors having ejecting mechanisms, as disclosed in the above Japanese Unexamined Patent Publication No. 8(1996)-203608 and U.S. Pat. No. 5,577,922, comprise a lever that extend along the lateral edge of a card. However, in the case that the lever is shaped in this manner, it is impossible to mount the aforementioned large cards into these connectors. If the lever is miniaturized, it will be covered by a portion of the large card. Therefore, particularly in the case that a great number of card edge connectors are arranged at high density, it becomes difficult for fingers to approach the levers, thereby precluding operation thereof. Assuming that the levers are able to be operated, it becomes necessary to provide spaces, which are sufficiently large to enable fingers to approach the levers and to enable rotation thereof, adjacent to the card edge connectors having ejecting mechanisms. For this reason, there is a problem that card edge connectors having ejecting mechanisms, other card edge connectors, and electronic components cannot be mounted on a motherboard at high density.

SUMMARY OF THE INVENTION

The present invention has been developed in view of the above circumstances. It is an object of the present invention to provide a card edge connector having an ejecting mechanism that enables easy ejection of cards, even in cases in which fingers or jigs cannot access ejectors.

The card edge connector having an ejecting mechanism of the present invention comprises an insulative housing having a slot for receiving a first edge of a card with an engaging protrusion that protrudes toward the exterior in the longitudinal direction of the insulative housing from the vicinity of the first edge, in a state in which the card is mounted within the slot, along which first edge conductive pads are provided. A plurality of electrical contacts are provided on the card edge connector for electrically contacting the conductive pads. An ejector is mounted only at one end in the longitudinal direction of the insulative housing, for ejecting the card. The ejector comprises a stopper for preventing the engaging protrusion from being disengaged. The ejector is pivotally mounted so as to be rotatable, thereby enabling the stopper to engage and disengage the engaging protrusion. When a second edge of the card, opposite from the first edge, is pulled in a direction substantially opposite to the insertion direction of the card, the card rotates about the first edge, while the engaging protrusion urges the stopper to rotate the ejector, thereby disengaging the stopper from the engaging protrusion.

A configuration may be adopted, wherein the ejector comprises a locking portion that engages the insulative housing while the ejector is engaged with the card. The locking portion is constructed to fittingly engage the insulative housing such that the fitting engagement is released when the card is pulled at its second edge thereby causing the ejector to rotate.

A configuration may be adopted, wherein the ejector comprises a pressing surface, which is pressed by the card to rotate the ejector to a receiving position, at which the card is received in the card edge connector. The pressing surface may be an inclined surface, which is formed integrally with the engaging protrusion along the insertion direction of the card. Alternatively, the pressing surface may be a flat surface, which is formed integrally with the engaging protrusion in a direction that opposes the insertion direction of the card.

Even in cases that fingers, jigs and the like cannot access the ejector due to the card being large or due to insufficient space in the periphery of the card edge connector, the card can be easily ejected simply by pulling on the side of the card opposite the ejector in an extraction direction.

In the case that the pressing surface is an inclined surface, which is formed integrally with the engaging protrusion along the insertion direction of the card, the card can be inserted after abutting the inclined pressing surface. Therefore, the insertion procedure is facilitated. Alternatively, in the case that the pressing surface is a flat surface, which is formed integrally with the engaging protrusion in a direction that opposes the insertion direction of the card, the flat pressing surface can be visually confirmed during insertion of the card. Therefore, the operability of the card edge connector is extremely high.

BRIEF DESCRIPTION OF THE DRAWINGS

FIG. 1A and FIG. 1B illustrate a card edge connector having an ejecting mechanism according to an exemplary embodiment of the present invention, wherein FIG. 1A is a plan view, and FIG. 1B is a right side view thereof.

DESCRIPTION OF THE PREFERRED EMBODIMENT

Figure 1A:
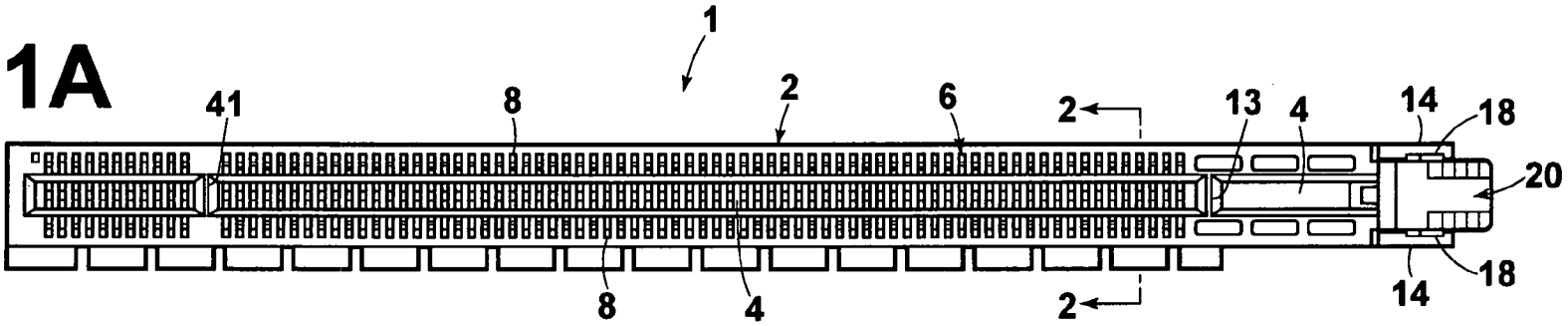
Figure 1B:
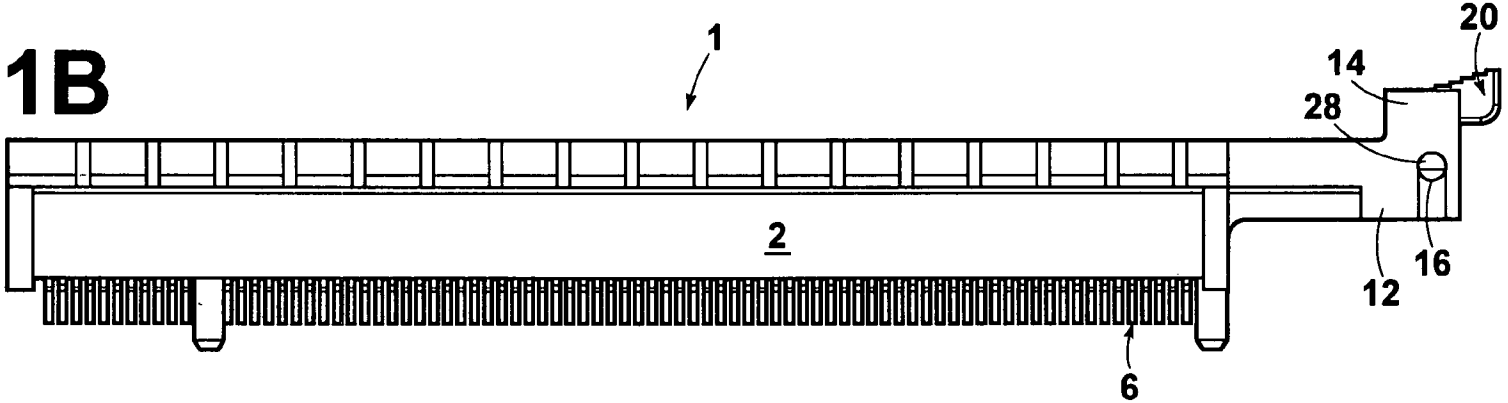

Hereinafter, a preferred embodiment of the card edge connector having an ejecting mechanism (hereinafter, simply referred to as "card edge connector") of the present invention will be described in detail with reference to the attached drawings. As illustrated in FIGS. 1A and 1B, the card edge connector 1 comprises an elongate substantially rectangular insulative housing 2. A slot 4, which is open toward above, for receiving a card, to be described later, is formed in the insulative housing 2, along the longitudinal direction thereof. A great number of contact cavities 8 are formed at predetermined intervals on both sides of the slot 4. An electrical contact 6 is press fit and held in each contact cavity 8.

Figure 2:
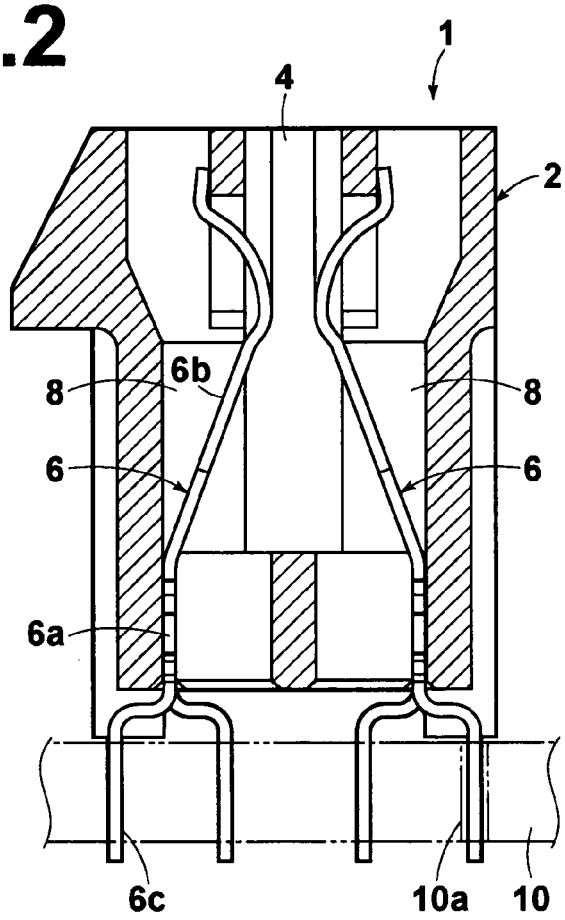
FIG. 2 is a magnified sectional view of the card edge connector of FIGS. 1A and 1B, taken along line 2—2 of FIG. 1A.

As best illustrated in FIG. 2, each electrical contact 6 comprises: a press fit portion 6*a*, which is press fit into the insulative housing 2; a contact portion 6*b* that extends upward from the press fit portion 6*a*; and a tine portion 6*c* that extends eccentrically downward from the press fit portion, in a manner such that the tine portions 6*c* of all of the electrical contacts 6 are staggered. The card edge connector 1 is secured to a motherboard 10 (printed circuit board) by the tine portions 6*c* being inserted through apertures 10*a* of the motherboard 10 and soldered thereto.

Walls 13 and 41 are integrally formed with the insulative housing 2, at predetermined locations to the left and to the right of the slot 4. The walls 13 and 41 extend in the insertion/extraction direction of a card 100 (refer to FIG. 10), which will be described later. An extension 12 is formed on the insulative housing 2 at a first end thereof, that is, to the right of the wall 13 in FIG. 1A. The slot 4 is open toward the top (out of the paper in FIG. 1A) and to the sides at the extension 12, and no contacts are provided thereat. Hereinafter, the extension 12 will be described with reference to FIG. 3.

Figure 3:
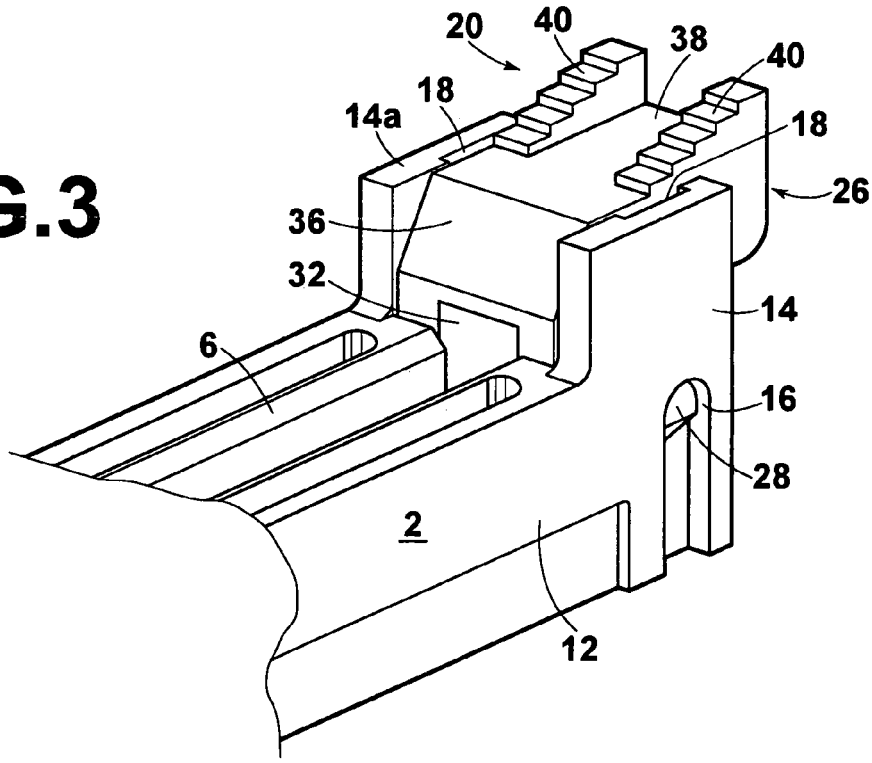
FIG. 3 is a partial magnified perspective view of an extension of the card edge connector of FIGS. 1A and 1B.

FIG. 3 is a partial magnified perspective view of the extension 12 of the card edge connector 1. The extension 12 comprises a pair of vertically extending support walls 14, which are integrally formed with the insulative housing 2. The slot 4 within the extension 12 is open at the first end of the insulative housing 2, that is, between the pair of support walls 14. Support apertures 16 for supporting an ejector 20 are formed in the vertical centers of the support walls 14 so as to penetrate through the insulative housing 2 across the slot 4. Grooves 18 that extend vertically from the upper edges of the support walls 14 to the support apertures 16 are formed in the inner surfaces of the support walls 14. The ejector 20, which constitutes an ejecting mechanism, is rotatably mounted in the support apertures 16.

Figure 4:
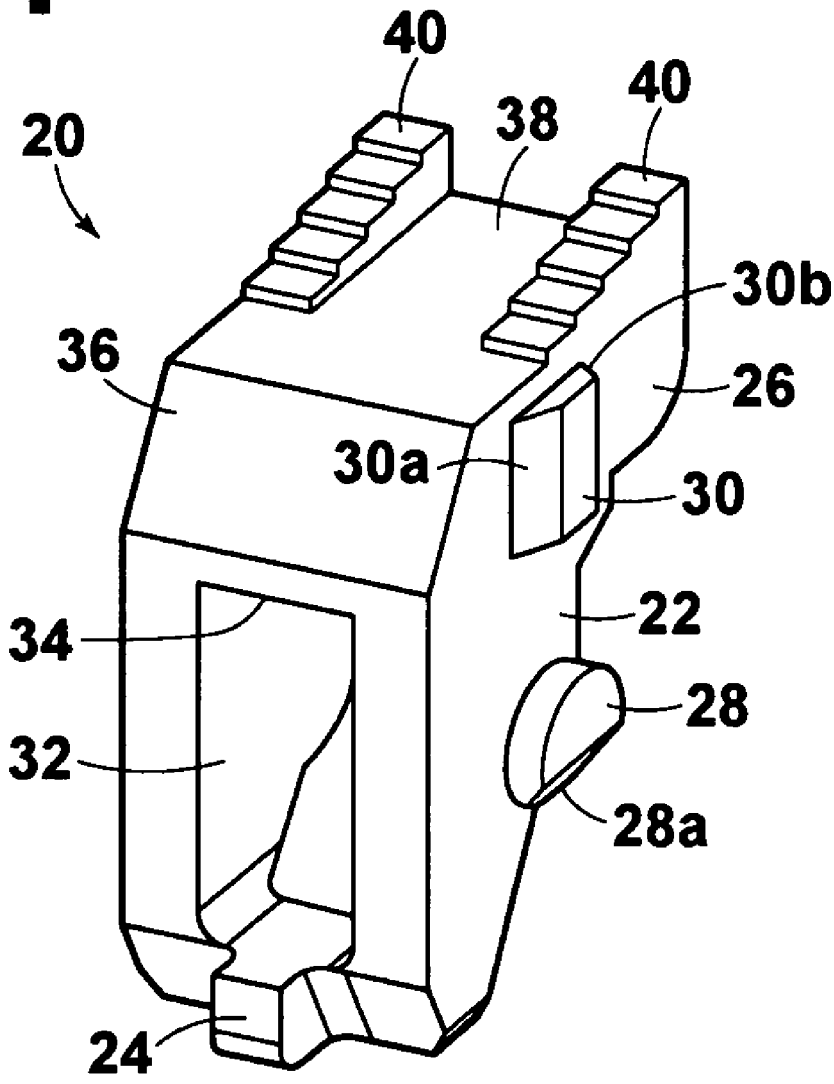
FIG. 4 is a perspective view of an ejector of the card edge connector of FIGS. 1A and 1B.
Figure 5C:
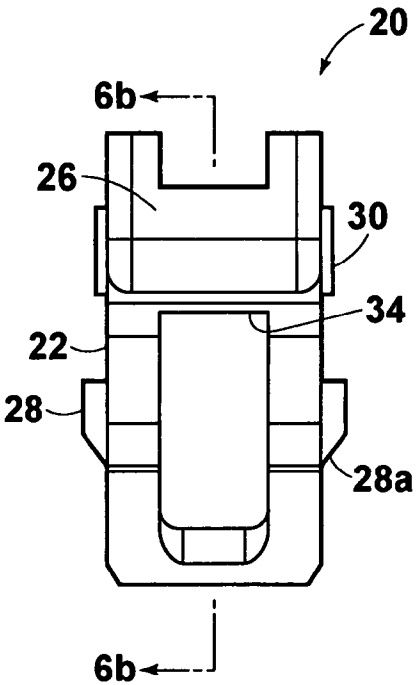
FIG. 5C is a rear view of the ejector of the card edge connector of FIGS. 1A and 1B.
Figure 5B:
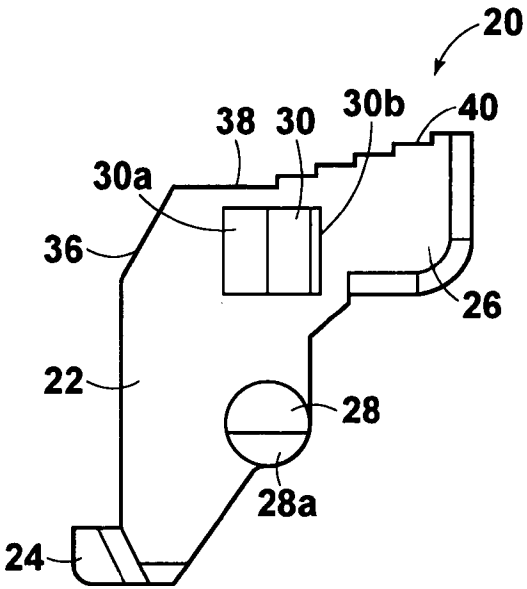
FIG. 5B is a right side view.
Figure 5A:
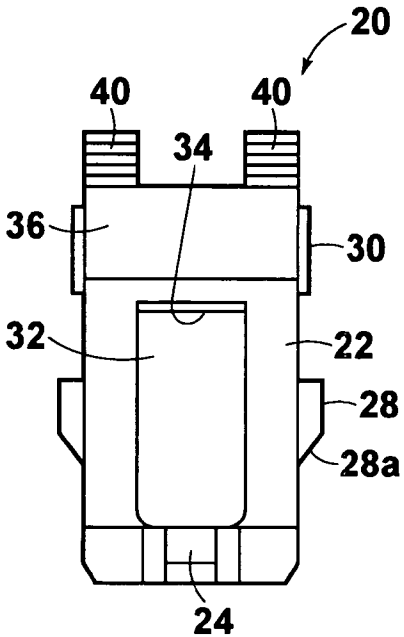
FIG. 5A is a front view.
Figure 6A:
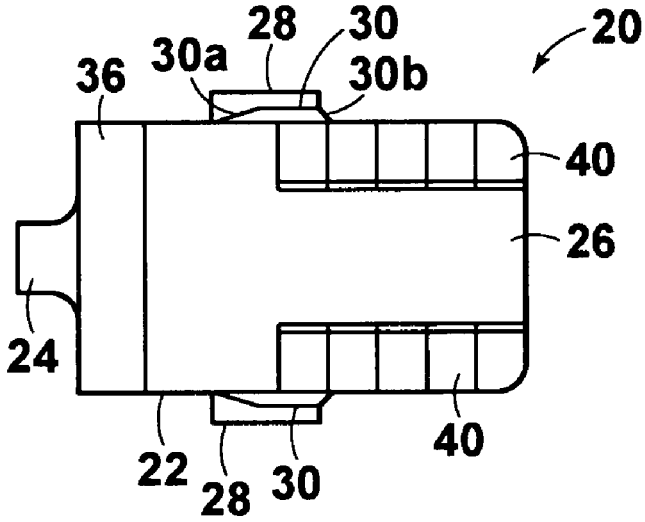
FIG. 6A is a plan view.
Figure 6B:
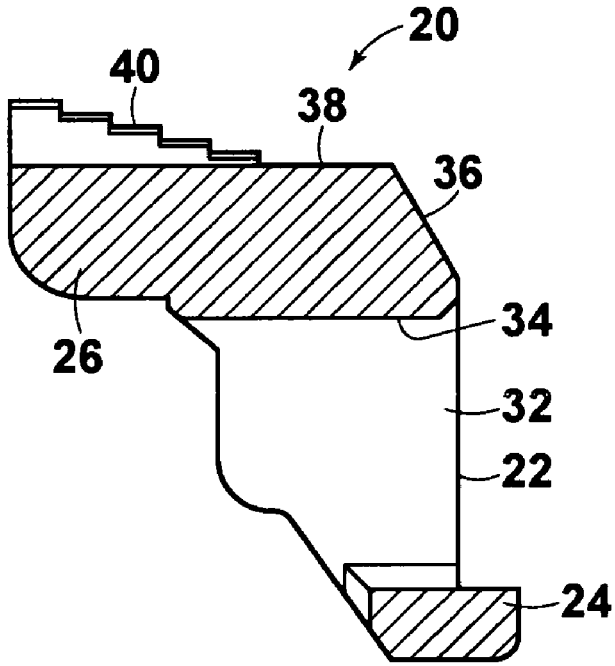
FIG. 6B is a sectional view of the ejector taken along the line 6B—6B of FIG. 5C.

Next, the ejector 20 will be described with reference to FIGS. 4 through 6. FIG. 4 is a perspective view of the ejector 20. FIG. 5A is a front view, FIG. 5B is a right side view, and FIG. 5C is a rear view of the ejector 20. FIG. 6A is a plan view of the ejector 20, and FIG. 6B is a sectional view taken along the line 6B—6B of FIG. 5C. The ejector is integrally molded by synthetic resin, and comprises: a main body 22 that extends in the vertical direction; an ejecting protrusion 24 that protrudes toward the slot 4 from the lower edge of the main body 22; and an operating portion 26 that extends in a direction opposite that of the ejecting protrusion 24 from the upper edge of the main body 22.

A pair of circular rotational shafts 28 are formed in opposing directions, at the approximate center of each side surface of the main body. The rotational shafts pass through the aforementioned grooves 18 of the insulative housing 2, to be supported within the support apertures 16. Downwardly facing tapers 28*a* are formed on the rotational shafts 28, thereby facilitating insertion thereof into the grooves 18 during mounting of the ejector 20 onto the insulative housing 2.

Rectangular engaging protrusions 30 (locking portions) are formed above each rotational shaft 28. Each engaging protrusion 30 comprises a gently inclined surface 30*a* toward the side of the slot 4, and a sharply inclined surface 30*b* toward the side opposite that of the gently inclined surface 30*a*. The engaging protrusions 30 fittingly engage with the aforementioned grooves 18, to be secured to the insulative housing 2. A vertically extending rectangular engaging aperture 32 that corresponds to the slot 4 is formed in the main body 22. The upper edge of the engaging aperture 32 is a stopper 34 for engaging a card, to be described later. The disengagement prevention function of the stopper 34 will be described in detail later.

An inclined surface 36 (first pressing surface) is formed along the insertion direction of a card 100 (miniature circuit board, refer to FIG. 7) on the operating portion 26 toward the slot 4. An engaging protrusion 106 (refer to FIG. 7) of the card 100, to be described later, is to press against the inclined surface 36. A flat surface 38 (second pressing surface) is formed in a direction that opposes the insertion direction of the card on the upper surface of the operating portion 26. The engaging protrusion 106 of the card 100 is to press against the flat surface 38 as well the inclined surface 36. Stepped finger applying portions 40 are formed on both sides of the flat surface. Engagement between the ejector 20 and the insulative housing 2 can be released by pressing the card 100 against the inclined surface 36 and the flat surface 38. The details of the release operation will be described later.

Figure 7:
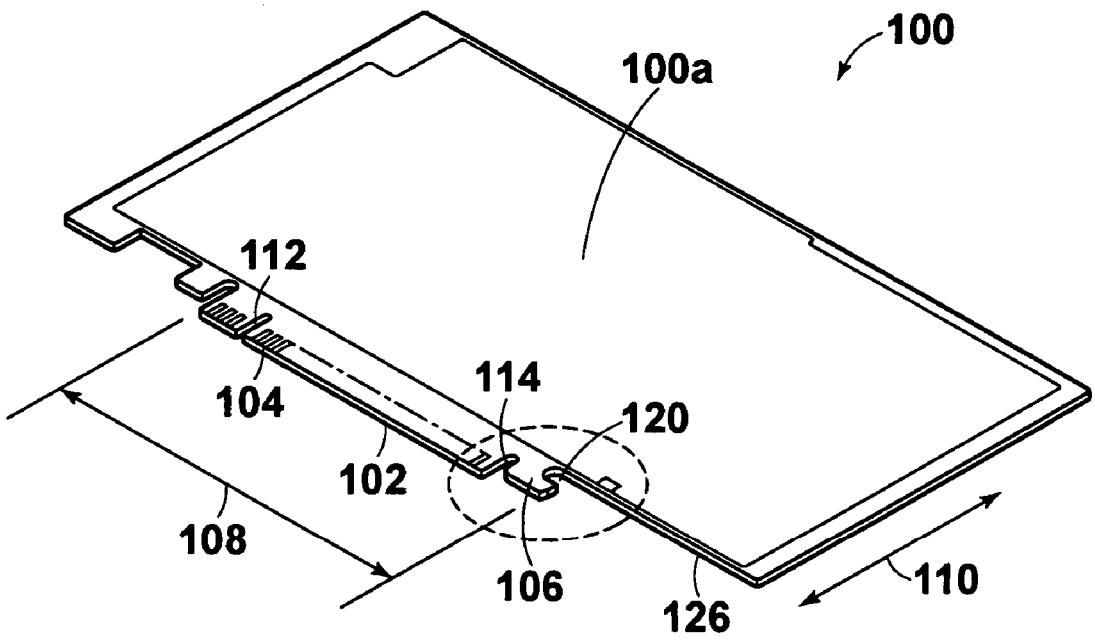
FIG. 7 is a perspective view of a card, which is to be inserted into the card edge connector having an ejecting mechanism of the present invention.

Next, the card 100, which is to be inserted into the slot 4 of the insulative housing 2, will be described with reference to FIG. 7. FIG. 7 is a perspective view of the card 100. The card 100 is substantially rectangular in shape and conforms to the PCI EXPRESS standard. Electronic components (not shown) are mounted on a main surface 100*a* of the card 100. A great number of conductive pads 104 are arranged at predetermined intervals at a first edge 102 of the card 100.

The outwardly extending engagement protrusion 106 is formed at a position on the card 100 that corresponds to the first end in the longitudinal direction of the insulative housing 2. A recess 120 is formed between the engaging protrusion 106 and the main surface 100*a*. An enlarged width portion 126 of the card 100 is formed continuous with the recess 120. The region denoted by reference numeral 108 in FIG. 7 is the portion of the card 100 which is inserted into the slot 4 of the insulative housing 2. Note that cutouts 112 and 114 that extend in the insertion/extraction direction 110 of the card 100 and open toward the edge 102 are formed in the card 100. The cutout 112 receives the wall 41 within the slot 4 of the insulative housing 2, to position the card 100 therein. The cutout 114 is formed at a position corresponding to the wall 13 of the slot 4.

Figure 8:
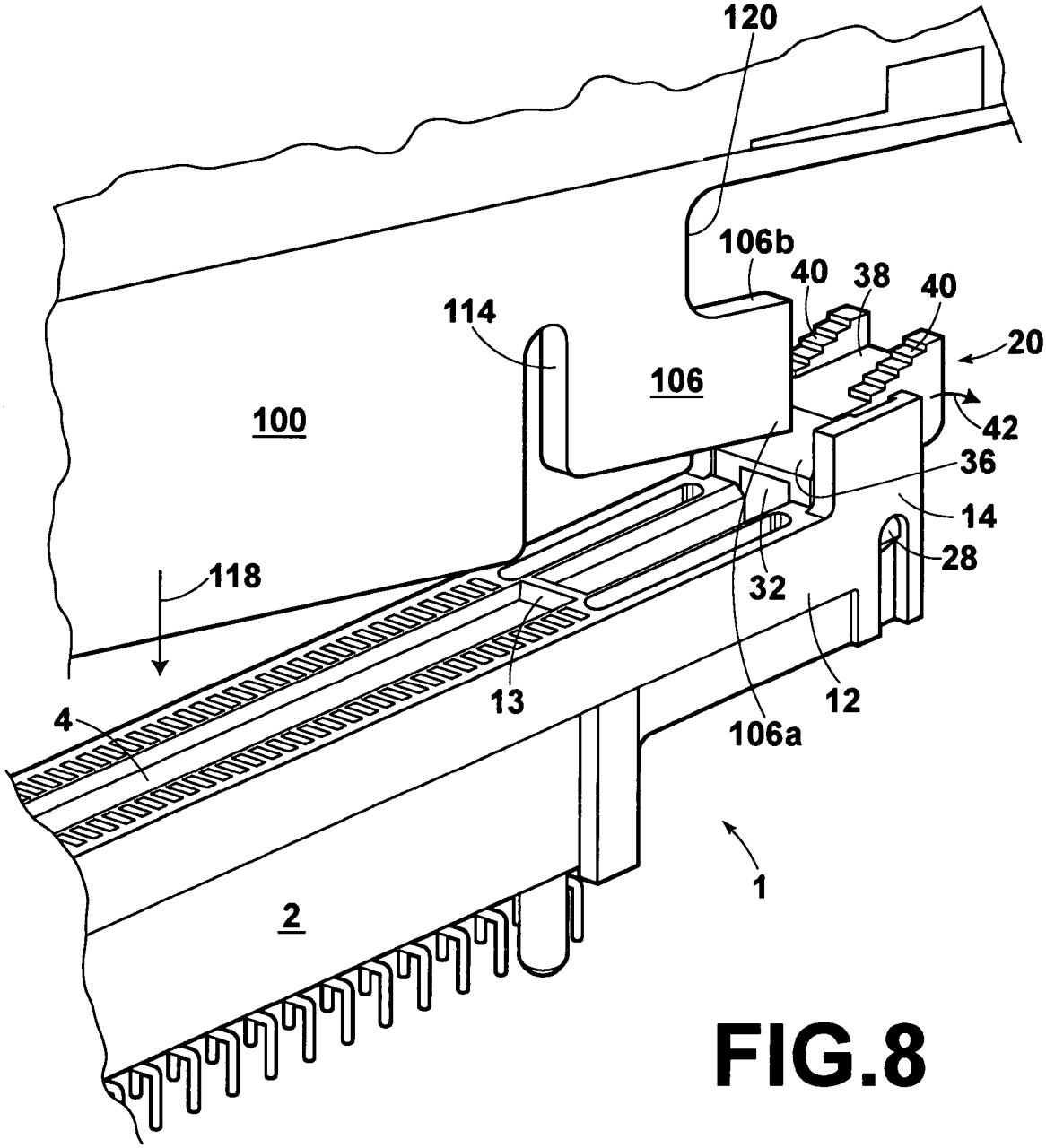
FIG. 8 is a partial magnified view of a state in which the card of FIG. 7 is being inserted into the card edge connector having an ejecting mechanism of the present invention.

Next, the manner in which the card 100 is inserted into the card edge connector 1 will be described with reference to FIG. 8. FIG. 8 is a partial magnified view of a state in which the card 100 is being inserted into the card edge connector 1. The portion of the card 100, which is surrounded by the broken line in FIG. 7, is illustrated in FIG. 8. The ejector 20 is normally in a locked state so that it does not move during transport and assembly. When the card 100 is inserted into the card edge connector 1 by pressing it toward the slot 4 in the direction indicated by arrow 118, a corner 106*a* of the engaging protrusion 106 abuts the inclined surface 36. The abutment applies a rotational force to the ejector 20 in the direction indicated by arrow 42, by cam action. As a result, the engagement between the engaging protrusions 30 and the grooves 18 is released. The sharply inclined surfaces 30*b* are formed on the engaging protrusions 30 of the ejector 20. Therefore, the engagement between the sharply inclined surfaces 30*b* and the grooves 18 is released if a certain degree of rotational force is applied to the ejector 20. Accordingly, during insertion of the card 100, it is not necessary to open the ejector 20 by operating the operating portion 26 with a finger. It goes without saying, however, that the ejector may be manually opened, if there is sufficient space for fingers in the periphery of the ejector 20.

Figure 9:
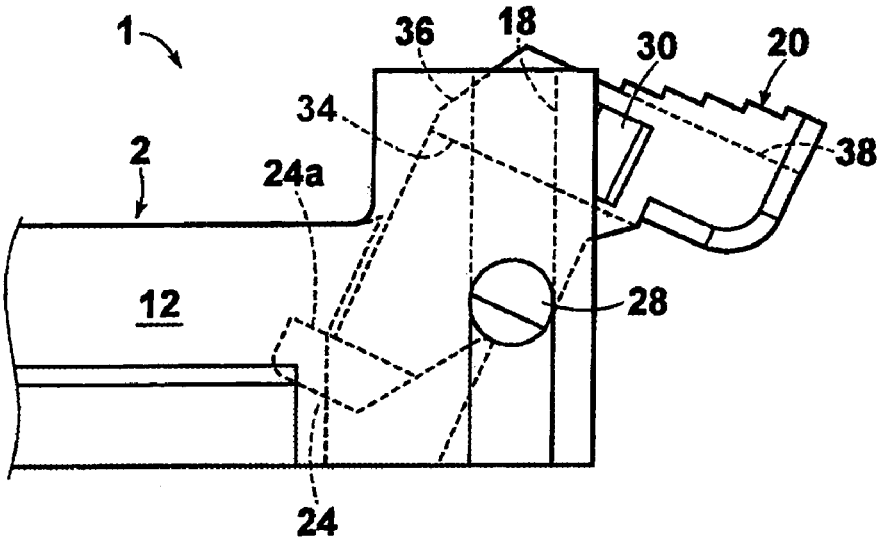
FIG. 9 is a partial magnified view illustrating a state in which the ejector is sufficiently rotated.

The rotation of the ejector 20 at this time will be described with reference to FIG. 9. FIG. 9 is a partial magnified view illustrating a state in which the ejector 20 is sufficiently rotated. When the engaging protrusions 30 of the ejector are disengaged from the grooves 18, the ejector 20 opens outward. Thereby, the engaging aperture 32 faces upward, facilitating insertion of the engaging protrusion 106. If the card 100 is inserted into the slot 4 in this state, the corner 106*a* of the engaging protrusion 106 presses the upper surface 24*a* of the ejecting protrusion 24 downward Thereby, the ejector 20 is rotated counterclockwise, the card 100 is mounted at a predetermined position, the engaging protrusions 30 engage the grooves 18, and the ejector 20 is locked. At this time, the engaging protrusion 106 of the card 10 is positioned directly below the stopper 34 within the engaging aperture 32. Therefore, the card 100 is locked within the slot 4, that is, prevented from being extracted therefrom.

A case has been described above in which the engagement protrusion 106 presses against the inclined surface 36 to rotate the ejector 20. Alternatively, the engagement protrusion 106 may press against the flat surface 38 of the ejector 20. In this case as well, a rotational moment that causes the ejector 20 to rotate is generated. Therefore, the engaging protrusions 30 disengage from the grooves and the ejector 20 is opened, as illustrated in FIG. 9. In addition, the portion of the card 100 that presses against the ejector 20 may be a portion other than the engaging protrusion 106.

Figure 10:
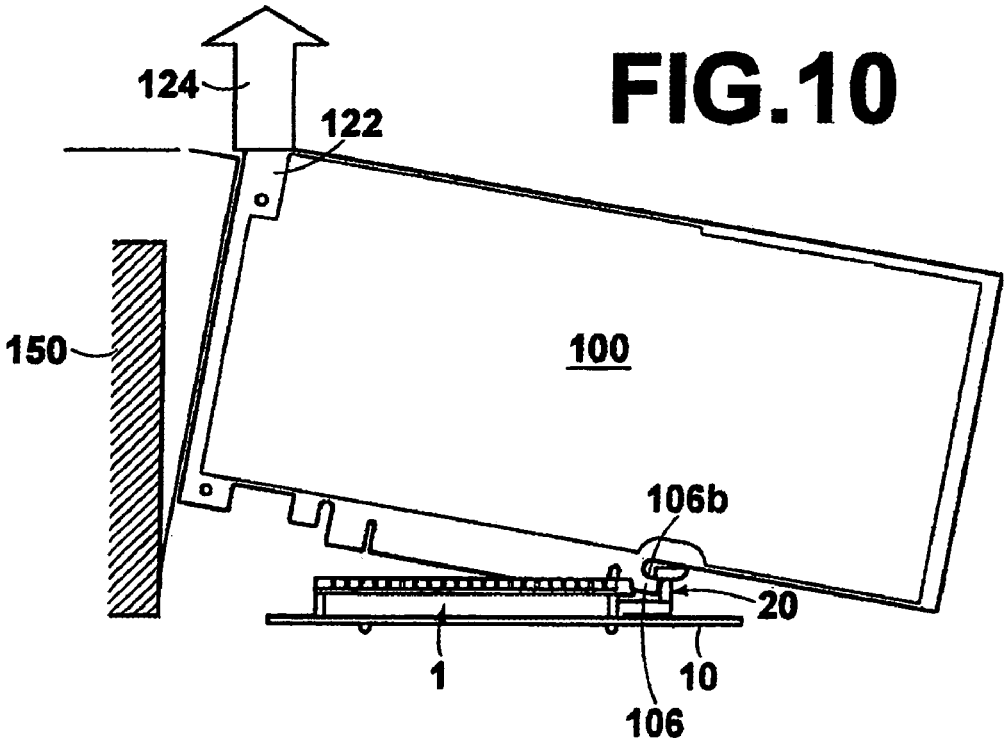
FIG. 10 is a front view illustrating a state in which the card is being removed from the card edge connector having an ejecting mechanism, which is mounted on a motherboard.

Next, the manner in which the card 100 is removed from the card edge connector 1 will be described with reference to FIG. 10. FIG. 10 is a front view illustrating a state in which the card 100 is being removed from the card edge connector 1, which is mounted on a motherboard 10. Note that to simplify the description, the card edge connector 1 is partially illustrated in a sectional view. When the upper edge 122 of the card 100 is lifted upward at the end of the card 100 opposite that of the engaging protrusion 106, the card 100 rotates about the first edge thereof, that is, the end at which the ejector 20 is positioned. At this time, the upper surface 106*b* of the engaging protrusion 106 abuts the stopper 34 of the ejector 20. The engaging protrusions 30 of the ejector 20 disengage from the grooves 18, and the ejector 20 is enabled to rotate in the clockwise direction. If the card 100 is continued to be lifted upward, the card 100 can be removed from the card edge connector 1. Accordingly, it is not necessary to insert a finger to operate the ejector 20 when removing the card 100. Therefore, the card 100 can be removed easily. Note that if there is sufficient space, a finger may be inserted to press the finger applying portion 40 downward, to rotate the ejector 20, thereby releasing the engagement between the ejector 20 and the card 100.

Note that in FIG. 10, reference numeral 150 denotes a case of a computer or the like. It is possible to easily remove the card 100 from the card edge connector 1, even if the card 100 is extremely close to the case 150 when mounted in the card edge connector 1, as illustrated in FIG. 10. In addition, only space sufficient to accommodate the shift of the card 100 due to rotation thereof needs to be secured on the side of the first end of the card edge connector 1. Therefore, the card edge connector 1 may be mounted close to the case 150 at either side thereof.

What is claimed is:

1. A card edge connector having an ejecting mechanism, the edge card connector comprising:

an insulative housing having a slot for receiving a first edge of a card with an engaging protrusion that protrudes toward the exterior in the longitudinal direction of the insulative housing from the vicinity of the first edge, in a state in which the card is mounted within the slot, along which first edge conductive pads are provided;

a plurality of electrical contacts for electrically contacting the conductive pads; and an ejector, which is mounted only at one end in the longitudinal direction of the insulative housing, for ejecting the card; wherein:

the ejector comprises a stopper for preventing the engaging protrusion from being disengaged;

the ejector is pivotally mounted so as to be rotatable, thereby enabling the stopper to engage and disengage the engaging protrusion; and the ejector comprises a pressing surface, which is pressed by the card to rotate the ejector to a receiving position, at which the card is received in the card edge connector.

2. A card edge connector having an ejecting mechanism as defined in claim 1, wherein:

the pressing surface is an inclined surface, which is formed integrally with the engaging protrusion along the insertion direction of the card.

3. A card edge connector having an ejecting mechanism as defined in claim 1, wherein:

the pressing surface is a flat surface, which is formed integrally with the engaging protrusion in a direction that opposes the insertion direction of the card.

4. A card edge connector having an ejecting mechanism, the edge card connector comprising:

an insulative housing having a slot for receiving a first edge of a card with an engaging protrusion that protrudes toward the exterior in the longitudinal direction of the insulative housing from the vicinity of the first edge, in a state in which the card is mounted within the slot, along which first edge conductive pads are provided;

a plurality of electrical contacts for electrically contacting the conductive pads; and an ejector, which is mounted only at one end in the longitudinal direction of the insulative housing, for ejecting the card; wherein:

the ejector comprises a stopper for preventing the engaging protrusion from being disengaged;

the ejector is pivotally mounted so as to be rotatable, thereby enabling the stopper to engage and disengage the engaging protrusion;

the ejector comprises a locking portion that engages the insulative housing while the ejector is engaged with the card;

the locking portion has a biased taper to engage the insulative housing in a first direction of rotation and be released when the ejector to rotated in a second direction; and the ejector comprises a pressing surface, which is pressed by the card to rotate the ejector to a receiving position, at which the card is received in the card edge connector.

5. A card edge connector having an ejecting mechanism as defined in claim 4, wherein:

the pressing surface is an inclined surface, which is formed integrally with the engaging protrusion along the insertion direction of the card.

6. A card edge connector having an ejecting mechanism as defined in claim 4, wherein:

the pressing surface is a flat surface, which is formed integrally with the engaging protrusion in a direction that opposes the insertion direction of the card.

* * * * *

UNITED STATES PATENT AND TRADEMARK OFFICE

CERTIFICATE OF CORRECTION

PATENT NO. : 7,083,448 B2
APPLICATION NO. : 11/072934
DATED : August 1, 2006
INVENTOR(S) : Junichi Tanigawa It is certified that error appears in the above-identified patent and that said Letters Patent is hereby corrected as shown below:

Column 7, line 6, after "inclined surface" delete ", which is formed integrally with the engaging protusion along the insertion direction of the card"

Column 8, line 18, after "inclined surface" delete ", which is formed integrally with the engaging protusion along the insertion direction of the card"

Signed and Sealed this

Nineteenth Day of December, 2006

JON W. DUDAS
*Director of the United States Patent and Trademark Office*